US009320317B2

(12) United States Patent
Bernhard et al.

(10) Patent No.: US 9,320,317 B2
(45) Date of Patent: Apr. 26, 2016

(54) SOLE CONSTRUCTION

(71) Applicant: On Clouds GmbH, Heiden (CH)

(72) Inventors: Olivier Bernhard, Heiden (CH); Ilmarin Heitz, Zürich (CH)

(73) Assignee: ON CLOUDS GMBH, Heiden (CH)

( * ) Notice: Subject to any disclaimer, the term of this patent is extended or adjusted under 35 U.S.C. 154(b) by 331 days.

(21) Appl. No.: 13/839,004

(22) Filed: Mar. 15, 2013

(65) Prior Publication Data

US 2014/0259743 A1 Sep. 18, 2014

(51) Int. Cl.

| | |
|---|---|
| ***A43B 13/16*** | (2006.01) |
| ***A43B 13/18*** | (2006.01) |
| ***A43B 13/12*** | (2006.01) |
| ***A43B 13/14*** | (2006.01) |

(52) U.S. Cl.

CPC ..... *A43B 13/181* (2013.01); *A43B 13/127* (2013.01); *A43B 13/141* (2013.01)

(58) Field of Classification Search

CPC .... A43B 13/18; A43B 13/181; A43B 13/185; A43B 13/141; A43B 13/127; A43B 13/16

USPC ..... 36/28, 29, 3 B, 102, 103, 27

See application file for complete search history.

(56) References Cited

U.S. PATENT DOCUMENTS

| | | | | |
|---|---|---|---|---|
| 3,834,046 | A * | 9/1974 | Fowler | 36/28 |
| 4,130,947 | A * | 12/1978 | Denu | 36/30 R |
| 5,461,800 | A * | 10/1995 | Luthi et al. | 36/28 |
| 5,946,824 | A * | 9/1999 | Tighe et al. | 36/28 |
| 6,516,539 | B2 | 2/2003 | Nishiwaki et al. | |
| 7,152,343 | B2 | 12/2006 | Whatley | |
| 7,877,899 | B2 * | 2/2011 | Nishiwaki et al. | 36/28 |
| 7,941,941 | B2 * | 5/2011 | Hazenberg et al. | 36/28 |
| 8,196,315 | B2 | 6/2012 | Ryu | |
| 8,365,445 | B2 * | 2/2013 | Sink | 36/103 |
| 9,015,962 | B2 * | 4/2015 | Boudreau et al. | 36/25 R |
| 2004/0154189 | A1 * | 8/2004 | Wang | 36/28 |
| 2004/0194343 | A1 * | 10/2004 | Kim | 36/29 |
| 2011/0016749 | A1 * | 1/2011 | Callahan et al. | 36/103 |
| 2014/0259748 | A1 * | 9/2014 | Bernhard et al. | 36/29 |

OTHER PUBLICATIONS

Office Action mailed Jul. 7, 2015; in U.S. Appl. No. 13/839,306.
Notice of References Cited mailed Jul. 7, 2015; in U.S. Appl. No. 13/839,306.

* cited by examiner

*Primary Examiner* — Jila M Mohandesi
(74) *Attorney, Agent, or Firm* — Polsinelli PC

(57) ABSTRACT

In a sole construction for a running shoe having an outer sole and an intermediate sole, the sole construction including a plurality of hollow elements which are in each case closed off by front and rear flanks in the longitudinal direction of the sole construction but are open at the sides and have upper and lower inner faces at a mutual spacing. The hollow elements are configured to absorb forces which act on them during running in each case by elastic deformation with a reduction in the spacing between their inner faces and optionally by horizontal displacement of their inner faces with respect to one another. The hollow elements are configured to deform to such an extent that their upper and lower inner faces come into contact with one another, and that this contact prevents a horizontal displacement of their inner faces with respect to one another.

21 Claims, 3 Drawing Sheets

SOLE CONSTRUCTION

TECHNICAL FIELD

The present invention relates to a sole construction for a running shoe having an outer sole and an intermediate sole, the sole construction comprising a plurality of hollow elements which are in each case closed off by front and rear flanks in the longitudinal direction of the sole construction but are open at the sides and have upper and lower inner faces at a mutual spacing, the hollow elements absorbing forces which act on them during running in each case by elastic deformation with a reduction in the spacing between their inner faces and optionally by horizontal displacement of their inner faces with respect to one another, and the hollow elements being deformable to such an extent that their upper and lower inner faces come into contact with one another, and that this contact prevents a horizontal displacement of their inner faces with respect to one another.

PRIOR ART

WO03/103430 A1 has disclosed a sole construction of this type. The outer sole which comprises the hollow elements makes great deformations possible, even in the horizontal direction. The sole construction can therefore yield to the horizontal forces which are caused by the forward movement during running, as a result of which load peaks during stepping are reduced substantially. Secondly what is known as the floating effect which is usually associated with a horizontal deformation as a result of the collapse of the hollow elements is avoided effectively by way of mutual contact of their inner faces.

In the known sole construction, in each case a plurality of hollow elements are arranged behind one another and next to one another in the forefoot region and in the heel region in such a way that they can be deformed individually and therefore, in relation to the entire sole construction, locally. This possibility of local deformation allows the runner to roll off in a very wide variety of ways in a largely unimpeded manner as a result of the sole construction.

Secondly, as a result of their individual deformability, the hollow elements contribute practically nothing to the integral flexibility of the sole construction. In the sole construction of WO03/103430 A1, this ought to be defined above all by the properties of the intermediate sole, with regard to which, however, WO03/103430 A1 makes no more detailed comments.

GENERAL DESCRIPTION OF THE INVENTION

The invention sets itself the object of improving the known sole construction with regard to its integral flexibility. It is intended to promote the natural movement sequence of the foot during rolling off and in contrast rather counteract damaging movements.

According to the invention, this object is achieved by a sole construction as claimed in claim 1. Accordingly, the sole construction according to the invention is distinguished by the fact that the intermediate sole is provided with a panel which extends over the heel region, the midfoot region and the forefoot region of the sole construction, the panel being incompressible, but absorbing forces which act on it during running by elastic bending and predominantly defining the integral elastic flexibility of the sole construction by way of its bending properties, the panel having a lattice-shaped structure with longitudinal ribs and transverse ribs which end with their ends in each case in a circumferential edge, and the transverse ribs running from the lateral side to the medial side obliquely to the rear in the heel region and in the forefoot region and obliquely to the front in the midfoot region.

As a result of the elastic flexibility of the panel of the intermediate sole which predominantly defines the integral elastic flexibility of the sole construction by way of its bending properties, the sole construction can be adapted overall to the rolling movement of the foot, the panel at the same time imparting a certain integral stability to the sole construction.

The elastic flexibility of the panel also exists with regard to torsions about its longitudinal direction (that is to say about torsion axes which are oriented substantially parallel to said longitudinal direction), said panel preferably being rigid to different extents with regard to different rotational directions. As a result, with regard to torsions of this type, the heel region is coupled to the forefoot region in an elastically flexible but not rigid manner.

As a result of its lattice-shaped structure, the panel is lighter in comparison with a panel of continuous thickness, and requires less material to produce. Its bending properties can be set differently at every location of its area with regard to differently oriented bending axes in a simple way by suitable orientation, thickness and density of the ribs. Here, the longitudinal ribs primarily define the flexural stiffness or flexibility in the longitudinal direction (that is to say about bending axes which are oriented transversely with respect to their longitudinal extent) and the transverse ribs define the flexural stiffness or flexibility in the transverse direction (that is to say about bending axes which are oriented transversely with respect to their longitudinal extent).

By virtue of the fact that the transverse ribs run from the lateral side to the medial side obliquely to the rear in the heel region and in the midfoot region and obliquely to the front in the midfoot region, they are oriented over the length of the sole construction substantially in each case at right angles to what is known as the center-of-pressure curve. This curve runs approximately in an S-shaped manner over the sole area. As a result, the panel according to the invention is in each case somewhat more flexible along the center-of-pressure curve (that is to say about bending axes which are oriented transversely with respect thereto) than transversely with respect thereto (that is to say about bending axes which are oriented tangentially with respect thereto).

Advantageous embodiments and developments of the sole construction according to the invention are specified in the dependent claims.

Thus, for example, it can be provided that the width of the longitudinal ribs increases from the rear to the front.

For a defined, favorable stiffening of the midfoot region, the mutual spacing of the transverse ribs can be selected to decrease from the rear to the front as far as the middle of the midfoot region and to increase again from there.

A normal rolling movement is associated with a torsion of the foot about its longitudinal axis. Here, the foot is set down in the heel region tilted somewhat to the outside on the lateral side, that is to say with its outer edge, and turns to the inside during the rolling movement until it is lifted off again tilted somewhat to the inside in the forefoot region on the medial side with loading of the largest and second largest toes. In order to ensure an optimum pressure distribution of the foot on the panel, the lattice-shaped structure of the panel can additionally be provided with first diagonal ribs with further local stiffening in the heel region and in the midfoot region, which first diagonal ribs run from the rear on the medial side obliquely to the front on the lateral side. It is favorable here if the mutual spacing of the first diagonal ribs decreases from the rear to the front and/or if the acute angle between the first diagonal ribs and the longitudinal ribs increases from the rear to the front.

In addition, the panel can be pre-twisted in itself, to be precise in such a way that it is inclined to the lateral side in the heel region and to the medial side in the forefoot region. This also benefits the preferred setting down of the foot on the lateral side and the preferred rolling movement with functional inner torsion, and additionally counteracts disadvantageous movements such as excessively pronounced pronation and supination.

The stability of the panel and its elastic dimensional stability can also be increased additionally by second diagonal ribs which run from the rear on the lateral side to the front on the medial side in the heel region and from the rear on the medial side to the front on the lateral side in the forefoot region. A variation of the acute angle between the second diagonal ribs and the longitudinal ribs can also be provided here again; said acute angle should increase from the rear to the front in the heel region and decrease in the forefoot region.

The panel can be provided with 2-5, preferably 4 longitudinal ribs and/or 14-18, preferably 16 transverse ribs and/or 6-8, preferably 7 first diagonal ribs and/or 9-13, preferably 11 second diagonal ribs. The thickness of the ribs can be selected to be different in the individual regions and relative to one another and among one another, in particular can be selected to be greatest in the midfoot region.

In the sole construction according to the invention, the panel can be surrounded on all sides by an elastically deformable and compressible material of the intermediate sole and can be held by it.

Finally, the panel can be a molded part or a part which is produced by hot pressing.

BRIEF DESCRIPTION OF THE DRAWINGS

In the following text, one exemplary embodiment of the invention will be explained with reference to the drawings, in which.

WAY OF IMPLEMENTING THE INVENTION

Figure 1:
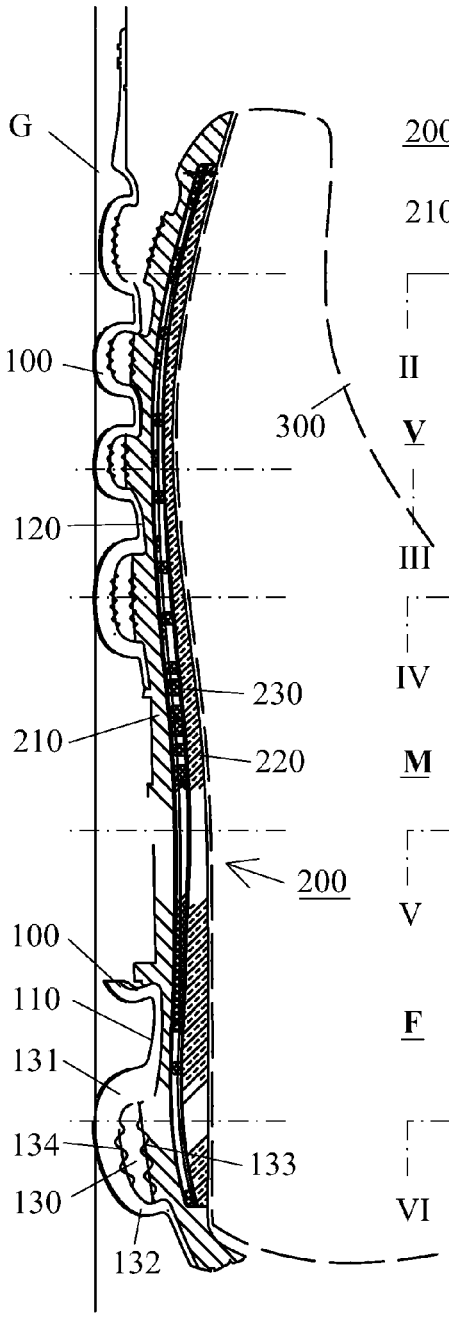
FIG. 1 shows a longitudinal section (I-I') of a sole construction according to the invention with an intermediate sole which has a panel which is embedded between a bottom part and a top part of the intermediate sole.

The sole construction, shown in the figures, of the exemplary embodiment has, from bottom to top, an outer sole 100 and an intermediate sole 200. A shoe upper 300 which is assembled thereon is merely indicated by dashed lines.

During use, the outer sole 100 comes into contact with the floor G. In the heel region F and in the forefoot region V, said outer sole 100 comprises at least the parts 110 and 120 which are made from an elastic, but practically incompressible rubber material and form hollow elements with the intermediate sole 200. The rearmost of said hollow elements is denoted by 130 in FIG. 1. Behind the layers 110 and 120, there are preferably further layers of this type in the transverse direction of the sole construction.

The hollow elements are in each case closed off by front and rear flanks in the longitudinal direction of the sole construction but are open at the sides. Their upper and lower inner faces which are provided with ribs are at a mutual spacing from one another. In FIG. 1, said flanks on the hollow element 130 are denoted by 131 and 132. The upper and lower inner faces are denoted by 133 and 134 on said hollow element 130. As a result, the hollow elements can absorb forces which act on them during running in each case by elastic deformation with a reduction in the spacing between their inner faces and optionally by horizontal displacement of said inner faces with respect to one another. Here, they are individually deformable to such an extent that their upper and lower inner faces come into contact with one another. This contact then prevents a horizontal displacement of their inner faces with respect to one another.

The intermediate sole 200 extends over the heel region F, the midfoot region M and the forefoot region V. In all three of these regions, said intermediate sole 200 is of three-layer construction and comprises a panel 230 between a bottom part 210 and a top part 220. The bottom part 210 and top part 220 are preferably composed of EVA, for example with a hardness of 55 Shore C. In contrast, the panel 230 is composed of a rigid-plastic, largely incompressible material; however, said panel 230 is flexible in itself under the forces which also act on it during running. The panel 230 predominantly defines the integral elastic flexibility of the entire sole construction by way of its bending properties.

Figure 2:
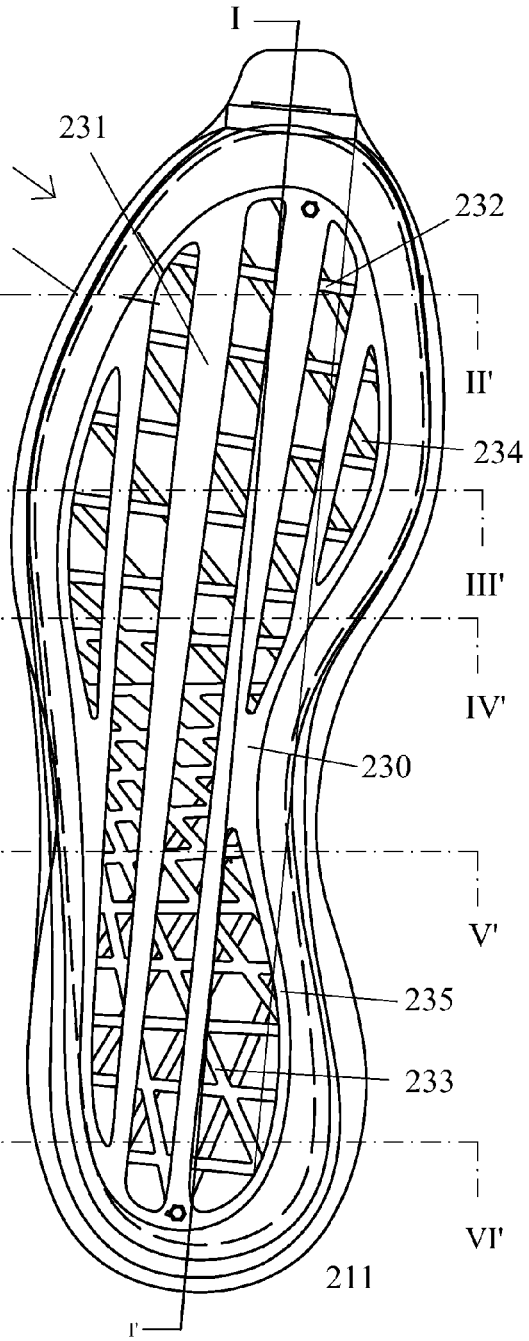
FIG. 2 shows a plan view of the sole construction from FIG. 1 with the top part of the intermediate sole removed.
Figure 3:
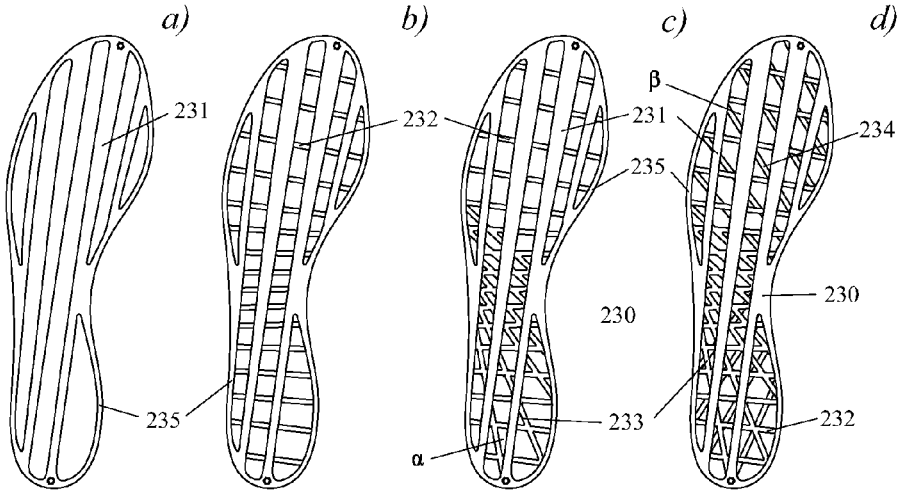
FIG. 3 shows, under a)-d), details of the panel which is embedded in the intermediate sole, in a plan view of the panel.

The panel 230 has a lattice-shaped structure, which can be seen in FIG. 2, with longitudinal ribs 231, transverse ribs 232 and first 233 and second diagonal ribs 234. In each case only one of said ribs is provided in each case with the corresponding designation. All the ribs 231-244 open with their ends into a circumferential edge 235. FIG. 3 shows the rib structure in a differentiated manner under a)-d). Under a), only the circumferential edge 235 and the longitudinal ribs 231 are shown. Under b), the transverse ribs 232 are added to the structure of a). Under c), the first diagonal ribs 233 are added to the structure of b). Under d), finally the second diagonal ribs 234 are also added to the structure of c), whereby the structure under d) corresponds to that of FIG. 2.

The width of the longitudinal ribs 231 increases from the rear, that is to say from the heel region F, to the front toward the forefoot region V.

The transverse ribs 232 run from the lateral side to the medial side of the sole construction obliquely to the rear in the heel region F and in the forefoot region V and obliquely to the front in the midfoot region M. They are therefore arranged substantially in each case at a right angle with respect to the center-of-pressure curve which is denoted by D. The mutual spacing of the transverse ribs 232 is also not constant. It decreases from the rear to the front as far as approximately the middle of the midfoot region M and increases again from there.

The first diagonal ribs 233 are arranged in the heel region F and in the midfoot region M. They run from the rear on the medial side obliquely to the front on the lateral side, their mutual spacing decreasing from the rear to the front. The acute angle between the first diagonal ribs 233 and the longitudinal ribs 231 increases from the rear to the front. One of the acute angles between the first diagonal ribs 233 and the longitudinal ribs 231 is denoted by a (alpha) under c) in FIG. 3.

The second diagonal ribs 234 run from the rear on the lateral side to the front on the medial side in the heel region F and from the rear on the medial side to the front on the lateral side in the forefoot region V. The acute angle between the second diagonal ribs 234 and the longitudinal ribs 231 increases from the rear to the front in the heel region F and decreases in the forefoot region. One of the acute angles between the second diagonal ribs 234 and the longitudinal ribs 231 is denoted by β (beta) under d) in FIG. 3.

Figure 4:
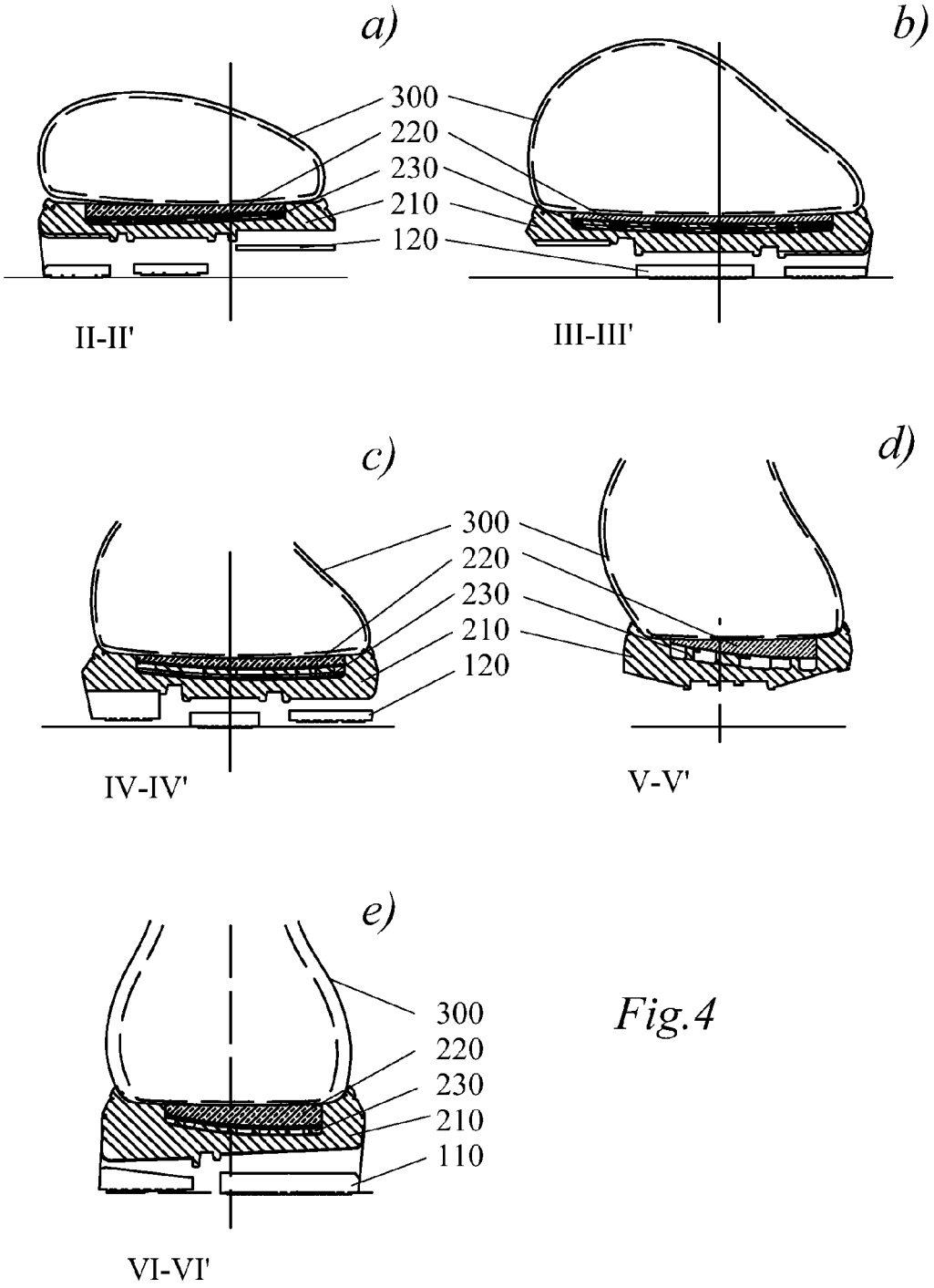
FIG. 4 shows, under a)-e), various horizontal sections (II-II'-VI-VI') of the sole construction.

As can be seen in the longitudinal section of FIG. 1 and in the cross sections of FIG. 4, the thickness of the ribs 231 is the greatest in the midfoot region M and decreases from there to the rear into the heel region F and to the front into the forefoot region V. This also applies to the circumferential edge 235. Here, the thickness of the longitudinal ribs 231 and of the edge 235 is greater than the thickness of the transverse ribs 232 and of the first diagonal ribs 233. This is in turn greater than the thickness of the second diagonal ribs 234. On their underside, all the ribs 231-234 are aligned with one another and with the edge 235. The different thicknesses therefore have an effect only on the top side.

In the exemplary embodiment which is shown, the panel 230 has 4 longitudinal ribs 231, 16 transverse ribs 232, 7 first diagonal ribs 233 and 11 second diagonal ribs 234.

As can be seen by comparison of the cross sections under a)-e) of FIG. 4, the panel 230 is twisted in itself in such a way that it is inclined to the lateral side in the heel region F and to the medial side in the forefoot region V.

As has already been mentioned, the panel 230 is embedded between the bottom part 210 and the top part 220 of the intermediate sole 200. Here, the bottom part 210 forms a type of tub with an elevated circumferential edge 211, which tub receives the panel 230. The top part 220 is connected to the bottom part along the edge 211 and covers the panel 230 as a result.

LIST OF DESIGNATIONS

100 Outer sole
110 Part of the outer sole
120 Part of the outer sole
200 Intermediate sole
210 Bottom part
211 Edge of the bottom part
220 Top part
230 Panel
231 Longitudinal ribs
232 Transverse ribs
233 First diagonal ribs
234 Second diagonal ribs
235 Panel edge
130 Hollow element
131 Front flank
132 Rear flank
133 Upper inner face
134 Lower inner face
300 Shoe upper
G Floor
F Heel region
V Forefoot region
M Midfoot region
α Angle
β Angle

What is claimed is:

1. A sole construction for a running shoe having an outer sole and an intermediate sole, the sole construction comprising:

a plurality of hollow elements, each of the plurality of hollow elements being closed off by a front flank and a rear flank in the longitudinal direction of the sole construction, each of the plurality of hollow elements being open at the sides, and each of the plurality of hollow elements having an upper inner face being spaced apart from a lower inner face, each of the hollow elements configured to absorb forces during running, wherein the absorption occurs during a reduction in the spacing between the upper inner face and the lower inner face and by a horizontal displacement of the upper inner face and the lower inner face with respect to one another, and the hollow elements being deformable such that the upper and lower inner faces come into contact with one another to prevent a horizontal displacement of the inner faces with respect to one another, wherein the intermediate sole is provided with a panel which extends over a heel region, a midfoot region and a forefoot region of the sole construction, the panel being incompressible, but absorbing forces which act on it during running by elastic bending and defining a majority of the integral elastic flexibility of the sole construction, and the panel having a lattice-shaped structure with a plurality of longitudinal ribs and a plurality of transverse ribs having two ends in a respective circumferential edge of the panel, each of the plurality of transverse ribs extending, from the lateral side of the panel to the medial side of the panel, obliquely to the rear in the heel region and in the forefoot region and obliquely to the front in the midfoot region.

2. The sole construction as claimed in claim 1, wherein the width of the longitudinal ribs increases from the rear to the front.

3. The sole construction as claimed in claim 1, wherein the mutual spacing of each of the plurality of transverse ribs decreases in a forward direction from the heel region to the midfoot region and increases in a forward direction from the midfoot region to the forefoot region.

4. The sole construction as claimed in claim 1, wherein the lattice-shaped structure of the panel additionally has a plurality of first diagonal ribs in the heel region and in the midfoot region, each of the plurality of first diagonal ribs extending in a forward direction from the medial side obliquely to the lateral side.

5. The sole construction as claimed in claim 4, wherein the mutual spacing of each of the plurality of first diagonal ribs decreases in a forward direction from the heel region to the midfoot region.

6. The sole construction as claimed in claim 4, wherein an acute angle between the first diagonal ribs and the longitudinal ribs increases from the rear to the front.

7. The sole construction as claimed in claim 1, wherein the lattice-shaped structure of the panel additionally has a plurality of second diagonal ribs, each of the plurality of second diagonal ribs extending in a forward direction from the lateral side of the heel region to the medial side of the heel region and from the medial side of the forefoot region to the lateral side of the forefoot region.

8. The sole construction as claimed in claim 7, wherein an acute angle between the second diagonal ribs and the longitudinal ribs increases in a forward direction from the heel region to the midfoot region and decreases in the forefoot region.

9. The sole construction as claimed in claim 1, wherein the thickness of the ribs is greatest in the midfoot region and decreases in a backward direction from the midfoot region to the heel region and decreases from the midfoot region to the forefoot region.

10. The sole construction as claimed in claim 1, wherein the thickness of the longitudinal ribs and of the edge is greater than the thickness of the transverse ribs and of the first diagonal ribs, and wherein the thickness of the transverse ribs and the thickness of the first diagonal ribs are greater than the thickness of the second diagonal ribs.

11. The sole construction as claimed in claim 1, wherein the each of the plurality of longitudinal ribs are aligned with one another on their underside, and each of the plurality of transverse ribs are aligned with one another on their underside.

12. The sole construction as claimed in claim 1, wherein the panel is provided with between 2 and 5 longitudinal ribs.

13. The sole construction as claimed in claim 1, wherein the panel is twisted such that the panel is inclined toward a lateral side of the heel region and inclined toward a medial side of the forefoot region.

14. The sole construction as claimed in claim 1, wherein the panel is a molded part.

15. The sole construction as claimed in claim 1, wherein the panel is surrounded on all sides by an elastically deformable and compressible material of the intermediate sole.

16. The sole construction as claimed in claim 1, wherein the panel is embedded in a cavity between a bottom part and a top part of the intermediate sole.

17. The sole construction as claimed in claim 1, wherein the panel is provided with between 2 and 5 longitudinal ribs and between 14 and 18 transverse ribs.

18. The sole construction as claimed in claim 4, wherein the panel is provided with between 2 and 5 longitudinal ribs and between 6 and 8 first diagonal ribs.

19. The sole construction as claimed in claim 7, wherein the panel is provided with between 2 and 5 longitudinal ribs and between 9 and 13 second diagonal ribs.

20. A sole construction for a running shoe, the sole construction comprising:

an outer sole;

an intermediate sole, coupled to the outer sole and comprising:

a lattice-shaped panel extending over a heel region, a midfoot region and a forefoot region, and being incompressible but configured to elastically bend and elastically flex, the panel comprising:

a plurality of longitudinal ribs; and a plurality of transverse ribs extending, from a lateral side to a medial side, in the heel region and in the forefoot region obliquely in a backward direction and in the midfoot region obliquely in a forward direction; and a plurality of hollow elements, each of the plurality of hollow elements being defined by:

a front flank and a rear flank closing off the hollow element in the longitudinal direction of the sole construction;

an opening at the lateral side and an opening the medial side of the sole construction;

an upper inner face being spaced apart from a lower inner face, wherein each of the hollow elements is configured to respond to absorbing forces during running by an elastic deformation including a reduction in the spacing between the upper inner face and the lower inner face and by a horizontal displacement of the upper inner face and the lower inner face with respect to one another, and wherein each of the hollow elements are deformable such that the upper and lower inner faces contact one another and are configured to prevent a horizontal displacement of the inner faces with respect to one another.

21. A sole construction for a running shoe, the sole construction comprising:

an outer sole;

an intermediate sole, coupled to the outer sole and comprising:

a lattice-shaped panel extending over a heel region, a midfoot region and a forefoot region, and being incompressible but configured to elastically bend and elastically flex, the panel comprising:

a plurality of longitudinal ribs; and a plurality of transverse ribs extending, from a lateral side to a medial side, obliquely to a rear portion of the heel region and a rear portion of the forefoot region and obliquely to a front portion of the midfoot region; and a plurality of hollow elements, each of the plurality of hollow elements comprising:

a front flank;

a rear flank, each rear flank being spaced apart from a corresponding front flank;

an upper inner face located between the front flank and the rear flank;

a lower inner face vertically spaced apart from the upper inner face and adjacent to the front flank and the rear flank, wherein each front flank and corresponding rear flank and each upper inner face and corresponding lower inner face form a hollow element, the hollow element configured to:

respond to absorbing forces during running by an elastic deformation with a reduction in the spacing between the upper inner face and the lower inner face and by a horizontal displacement of the upper inner face and the lower inner face with respect to one another, and deform such that the upper inner face and the lower inner face can contact one another to prevent a horizontal displacement of the inner faces with respect to one another.

* * * * *